US005657726A

United States Patent [19]

Diggs

[11] Patent Number: 5,657,726

[45] Date of Patent: Aug. 19, 1997

[54] ROCKER ARM ASSEMBLY FOR AN INTERNAL COMBUSTION ENGINE

[75] Inventor: Matthew B. Diggs, Farmington, Mich.

[73] Assignee: Ford Global Technologies, Inc., Dearborn, Mich.

[21] Appl. No.: 586,114

[22] Filed: Jan. 16, 1996

[51] Int. Cl.[6] ..... F01L 1/18

[52] U.S. Cl. ..... 123/90.36; 123/90.43; 123/90.44; 74/519; 74/559

[58] Field of Search ..... 123/90.33, 90.36, 123/90.39, 90.41, 90.42, 90.43, 90.44, 90.45, 90.46; 74/519, 559

[56] References Cited

U.S. PATENT DOCUMENTS

| | | | |
|---|---|---|---|
| 2,385,309 | 9/1945 | Spencer | 74/519 |
| 2,522,326 | 9/1950 | Winter, Jr. | 123/90.36 |
| 3,222,950 | 12/1965 | Winter, Jr. | 74/519 |
| 3,667,434 | 6/1972 | Sandusky | 123/90.41 |
| 4,539,953 | 9/1985 | Sasaki et al. | 123/90.41 |
| 4,598,674 | 7/1986 | Nono et al. | 123/90.41 |
| 4,676,203 | 6/1987 | Nouno | 123/90.42 |
| 4,796,483 | 1/1989 | Patel et al. | 74/519 |
| 4,944,257 | 7/1990 | Mills | 123/90.39 |
| 4,979,475 | 12/1990 | Mills | 123/90.39 |
| 5,016,582 | 5/1991 | Mills | 123/90.39 |
| 5,163,391 | 11/1992 | Green et al. | 123/90.39 |
| 5,259,346 | 11/1993 | Mills | 123/90.39 |
| 5,325,825 | 7/1994 | Schmidt et al. | 123/90.36 |

FOREIGN PATENT DOCUMENTS

| | | | |
|---|---|---|---|
| 5-179907 | 7/1993 | Japan | 123/90.39 |

*Primary Examiner*—Weilun Lo
*Attorney, Agent, or Firm*—Neil P. Ferraro

[57] ABSTRACT

A rocker arm assembly for an internal combustion engine has a removable valve stem locating member at one end thereof to locate the rocker arm relative to the valve stem during assembly of internal combustion engine, and a lubricating fluid directional control member at another end thereof for directing lubricating fluid from the pivot member, such as a hydraulic lash adjuster, toward the cam/rocker arm interface to provide lubricating fluid thereto. Once assembled, the valve stem locating member may be removed to further reduce the overall mass of the rocker arm assembly.

12 Claims, 2 Drawing Sheets

ROCKER ARM ASSEMBLY FOR AN INTERNAL COMBUSTION ENGINE

FIELD OF THE INVENTION

The present invention relates to a rocker arm assembly of the end-pivot, cam follower type for an internal combustion engine.

BACKGROUND OF THE INVENTION

Cam follower type rocker arms for internal combustion engines pivot about a fixed point in response to rotation of the cam. The rocker arm thereby activates a valve of the internal combustion engine. During assembly of the internal combustion engine, the valve train, which comprises the valve, valve spring, rocker arm, overhead cam and lash adjuster, are assembled to the cylinder head at a location remote from the remainder of the internal combustion engine. The cylinder head, with the valve train components attached thereon, is then transported to the location of the remaining portion of the internal combustion engine for assembly. During this transportation, the location of the rocker arm relative to the valve stem may move as the cylinder head is jostled in place. Relocating the rocker arm relative to the valve stem may result in increased assembly cost.

U.S. Pat. No. 4,539,953 discloses a rocker arm which is bifurcated at the valve actuating end, and which straddles the valve stem so as to locate the rocker arm relative to the valve stem. However, a problem with this approach exists in that a heavy mass at the actuating end which requires relatively more energy to move. In addition, the valve spring must be stronger to compensate for the added weight. All of this reduces engine efficiency and ultimately reduces fuel economy.

In addition, the rocker arm of U.S. Pat. No. 4,539,953 is a complicated design from a manufacturing standpoint. That is, after the rocker arm is formed, the valve guide at the valve actuating end must be machined during a secondary operation whereby a grinding tool of appropriate size must be guided through the bifurcated end of the rocker arm to smooth the surface. This may require special tooling and fixturing with the result being increased manufacturing cost. Also, the sides that straddle the valve stem must be relatively large, and thus heavy, to withstand this machining operation.

Further, it is known that directing lubricating oil toward the cam/rocker arm interface is desirable to reduce friction. To provide this lubricating oil, previous designs have incorporated a channel within the rocker arm that directs lubricating fluid from the pivot end to the cam/rocker arm interface. This channel is necessarily formed at an angle not perpendicular relative to any surface of the rocker arm and again may require special fixtures and increased machine setup time, thereby increasing manufacturing cost.

SUMMARY OF THE INVENTION

An object of the invention claimed herein is to reduce manufacturing and assembly cost while providing a lightweight, removable means for locating the rocker arm relative to the valve stem as well as providing a means for directing lubricating fluid to the interface between the cam and the rocker arm.

The above object is achieved, and problems of prior approaches overcome, by a rocker arm assembly for an overhead cam internal combustion engine having at least one valve. The rocker arm assembly includes a rocker arm body having a pivot end for engaging a pivot member of the engine, a valve actuating end opposite the pivot end for actuating the valve, and a cam responsive surface intermediate the pivot end and the valve actuating end for engaging the overhead cam. The rocker arm is responsive to the rotation of the cam such that, as the cam rotates, the rocker arm pivotally oscillates about the pivot member. An elastically tensioned valve stem locating member is removably fixed to the valve actuating end for locating the valve actuating end relative to the valve stem of the valve.

The above object is also achieved, and problems of prior approaches also overcome, by an internal combustion engine including a cylinder head, mounted to the cylinder block, and a valve train. The valve train includes a valve with a valve stem extending through the cylinder head, a biasing means for biasing the valve relative to the cylinder head, and a rocker arm for actuating the valve. The rocker arm has a pivot end, a valve actuating end engaging the valve stem of the valve, and a cam responsive surface intermediate the pivot end and the valve actuating end. The valve train also includes a hydraulic lash adjuster mounted to the cylinder head and being in fluid communication with engine lubricating fluid. The hydraulic lash adjuster engages the rocker arm at the pivot end and has a lubricating fluid channel therethrough for providing lubricating fluid from the hydraulic lash adjuster to the rocker arm. The pivot end of the rocker arm also has a lubricating fluid channel extending therethrough along an axis substantially perpendicular to a longitudinal axis of the rocker arm for receiving lubricating fluid from the hydraulic lash adjuster. The valve train also has an overhead cam rotatably mounted to the cylinder head in contact with the cam responsive surface of the rocker arm for pivotally oscillating the rocker arm about the hydraulic lash adjuster. The rocker arm includes a valve stem locating member removably fixed to the valve actuating end for locating the valve actuating end relative to the valve stem of the valve and a lubricating fluid directional control member removably fixed to the pivot end for directing lubricating fluid emerging from the channel in the pivot end toward the cam responsive surface.

The above object is also achieved, and problems of prior approaches also overcome, by a rocker arm having a rocker arm body, a generally inverted U-shaped elastically tensioned valve stem locating clip removably fixed to the rocker arm body and a generally inverted U-shaped elastically tensioned lubricating fluid directional control clip removably fixed to the rocker arm body. The rocker arm body has a pivot end having a lubricating fluid channel extending therethrough along an axis substantially perpendicular to a longitudinal axis of the rocker arm for engaging a pivot member of an internal combustion engine and having a recessed area around the perimeter thereof. The rocker arm also has a valve actuating end opposite the pivot end for actuating a valve of said engine, the valve actuating end has a recessed area on a top and a bottom surface thereof, and a cam responsive surface intermediate the pivot end and the valve actuating end for engaging an overhead cam of the engine. The rocker arm is responsive to the rotation of the cam such that, as the cam rotates, the rocker arm pivotally oscillates about the pivot member.

The valve stem locating clip is removably fixed within the top recessed area of the valve actuating end for locating the valve actuating end relative to a valve stem of the valve. The valve stem locating clip has elongate sides extending beyond the valve actuating end so as to engage opposite sides of the valve stem. Each side has an inwardly bent locking tab along the length thereof for engaging the bottom recessed area of the valve actuating end of the rocker arm.

The lubricating fluid directional control clip is removably fixed within the recessed area of the pivot end. A portion of a top member of the directional control clip is outwardly inclined relative to a top surface of the rocker arm thereby forming an opening facing the cam responsive surface. The directional control clip has elongate sides connected to the top member so as to engage the rocker arm within the recessed area of the pivot end. Each side has an inwardly bent locking tab at an end opposite the top member for engaging the recessed area of the pivot end.

An advantage of the above aspect of the invention is that a low cost rocker arm requiring little secondary machining may be produced.

Another advantage of the above aspect of the invention is that the rocker arm may be fixed relative to the valve stem during assembly of an internal combustion engine.

Still another advantage of the above aspect of the invention is that the member which locates the rocker arm relative to the valve stem may be removed after assembly so as to further reduce the mass at the valve actuating end which thereby has the attendant benefit of increasing fuel economy.

Yet another advantage of the above aspect of the invention is that lubricating fluid may be directed toward the cam/rocker arm interface without the need for uniquely machined lubricating channels within the rocker arm.

Yet another advantage of the above aspect of the invention is that the stiffness of the rocker arm may be greater without the need to add much weight by providing a light weight member at the actuating end to hold the rocker arm in place relative to the valve stem.

Other objects, features and advantages of the present invention will be readily appreciated by the reader of this specification.

BRIEF DESCRIPTION OF THE DRAWINGS

The invention will now be described, by way of example, with reference to the accompanying drawings in which.

DETAILED DESCRIPTION OF THE PREFERRED EMBODIMENT

Figure 1:
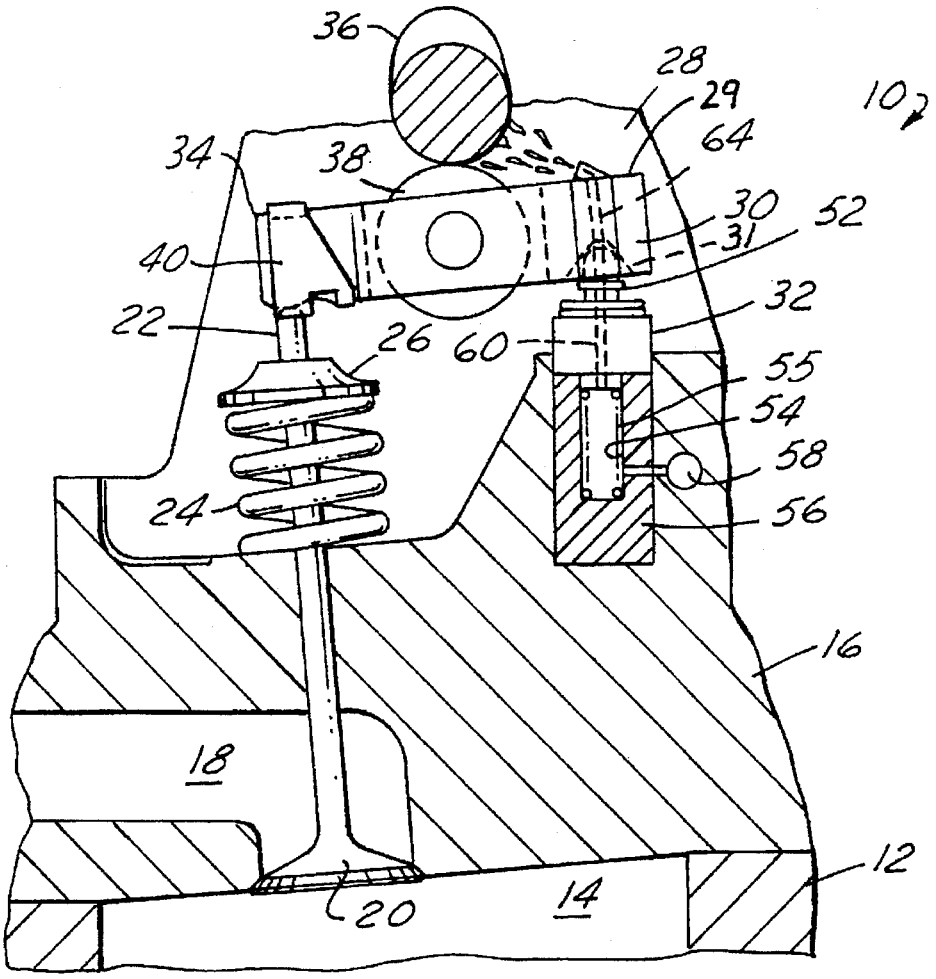
FIG. 1 is a diagrammatic cross-sectional view of an internal combustion engine having the rocker arm assembly according to the present invention.

Internal combustion engine 10 includes cylinder block 12 having a plurality of cylinders 14, one of which is shown in FIG. 1, and cylinder head 16 having port 18 (which may be an intake port or an exhaust port) intermittently communicating with cylinder 14 by the operation of valve 20. Valve 20 has valve stem 22 that extends upwardly from cylinder head 16, as viewed in FIG. 1, through coiled compression spring 24 located therearound and which is seated against cylinder head 16 and against retainer ring 26 mounted on the valve stem 22. Rocker arm assembly 28 has a body 29 and pivot end 30 formed with recess 31 that engages pivot member 32 within cylinder head 16. Pivot member 32 is typically a hydraulic lash adjuster. Rocker arm assembly 28 also has a valve actuating end 34 which acts on valve stem 22 to open valve 20 to allow communication between port 18 and cylinder 14. Overhead cam 36 engages cam responsive surface 38, which is rotatably fixed to body 29 of rocker arm assembly 28. As cam 36 rotates, rocker arm assembly 28 pivotally oscillates about pivot member 32 such that valve actuating end 34 acts on valve stem 22 to cause valve 20 to move longitudinally thereby opening or closing valve 20.

In the present example shown, cam responsive surface 38 of rocker arm assembly 28 is a roller bearing rotatably fixed to body 29. Thus, rocker arm assembly 28 is of a roller finger follower type. However, as would be apparent one of ordinary skill of the art in view of this disclosure, cam responsive surface 38 may simply be a bearing surface such that rocker arm assembly 28 is of the slider finger follower type.

Figure 2:
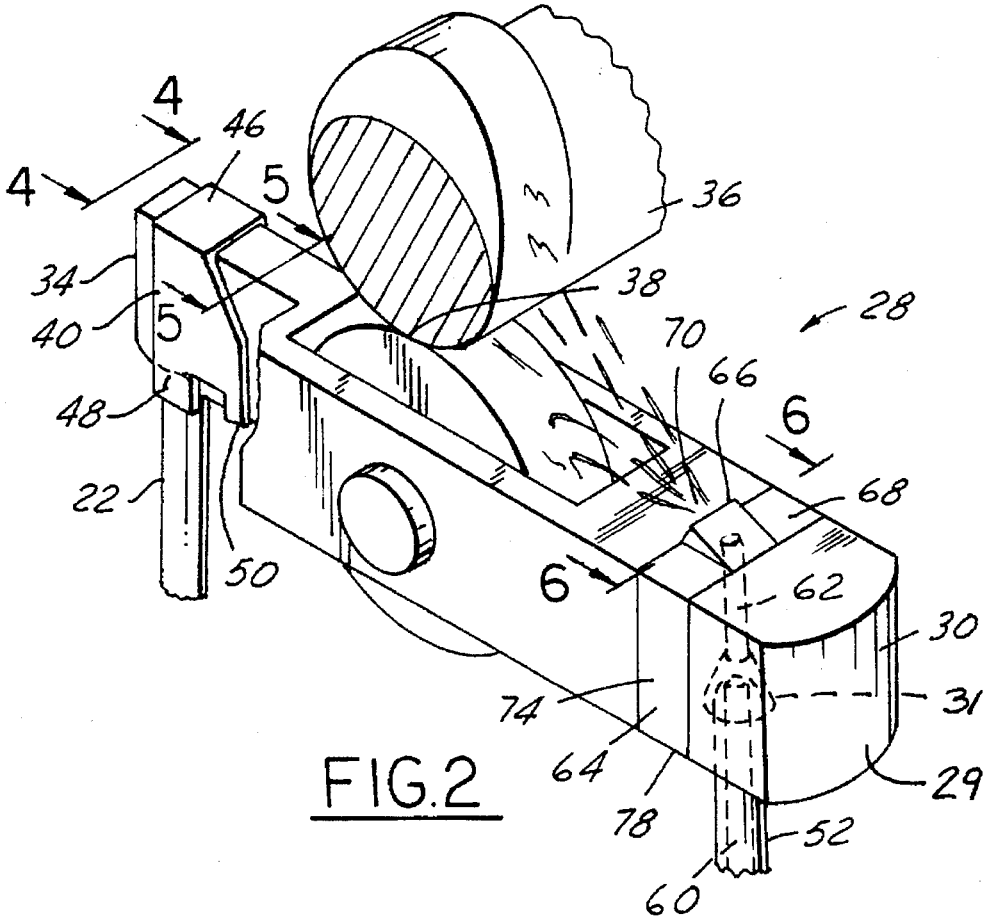
FIG. 2 is a diagrammatic perspective view of the rocker arm assembly according to the present invention.
Figure 3:
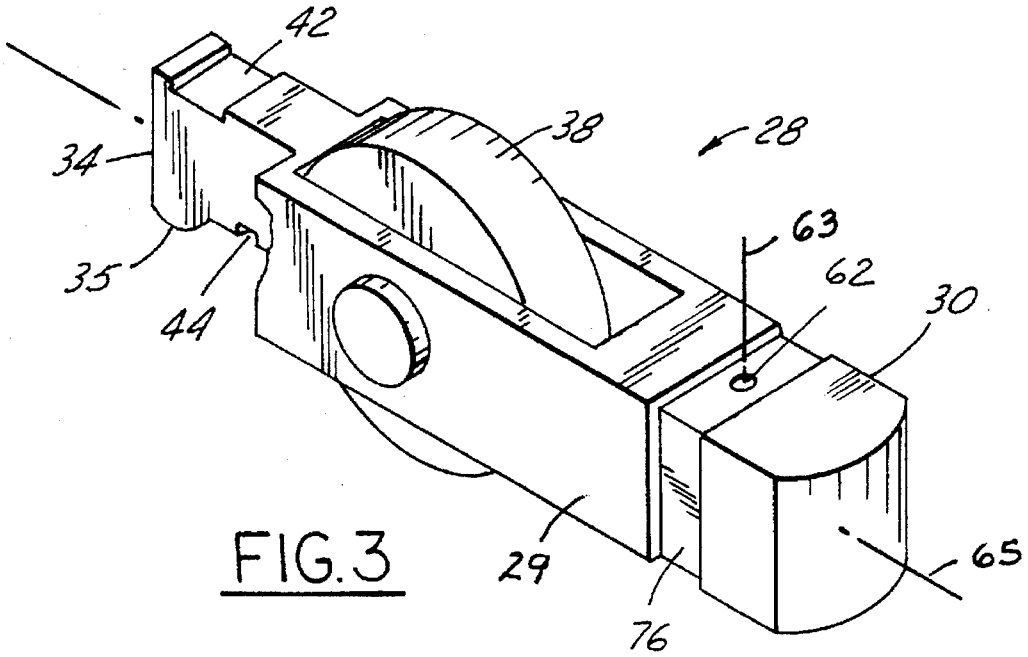
FIG. 3 is a diagrammatic perspective view of the body of the rocker arm assembly according to the present invention.

Rocker arm assembly 28 is fitted with valve stem locating member 40 at valve actuating end 34. As best shown in FIG. 2, valve stem locating member 40 clips onto valve actuating end 34 so as to hold valve stem 22 in place during assembly of internal combustion engine 10. Valve stem locating member 40 is formed of an elastically tensioned material such as spring steel so that valve stem locating member 40 is removably fixed to valve actuating end 34. To aid in securing valve stem locating member 40 to valve actuating end 34, recess 42 is formed in body 29 at the top of valve actuating end 34 (see FIG. 3). Valve stem locating member 40 is generally an inverted U-shaped member having a top portion 46, for engaging recess 42, and elongate sides 48 (one of which is shown in FIG. 2), which extend beyond valve actuating end 34 so as to straddle valve stem 22 on either side thereof (see also FIG. 4). Further, locking tabs 50 (one of which is shown in FIG. 2) are inwardly bent so as to engage recess 44 formed into body 29 at the bottom of valve actuating end 34 (see FIG. 3).

Figure 4:
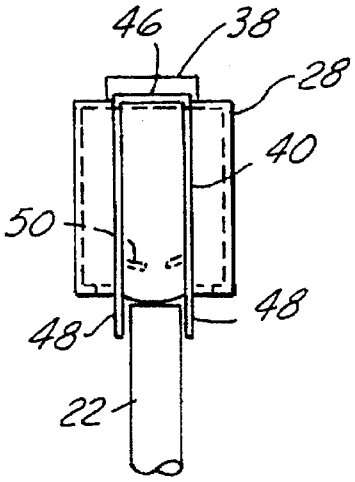
FIG. 4 is an end view of the rocker arm assembly of the present invention taken in a direction along line 4—4 of FIG. 2.
Figure 5:
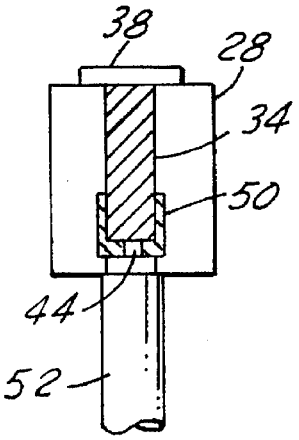
FIG. 5 is a cross-sectioned view of the rocker arm assembly of the present invention taken along line 5—5 of FIG. 2; and, FIG. 6 is a cross-sectioned view of the rocker arm assembly of the present invention taken along line 6—6 of FIG. 2.

FIGS. 4 and 5 best show valve stem locating member 40 straddling valve stem 22 and engaging valve actuating end 34. As previously stated, valve stem locating member 40 locates rocker arm assembly 28 relative to valve stem 22 during assembly of internal combustion engine 10. It may be desirable, however, to remove valve stem locating member 40 once assembly is complete so as to further reduce the mass at the valve stem actuating end 34, which has the attendant benefit of reducing valve train mass and increasing fuel economy. According to the present invention, this is achieved by valve stem locating member 40 being removably fixed to valve stem actuating end 34. The tendency of cam responsive surface 38 to remain aligned with cam 36, and the upward motion of pivot end 30 due to the action of plunger spring 55 of lash adjuster 32, reduces the possibility that valve actuating end 34 will become dislocated relative to valve stem 22 after assembly of engine 10 if valve stem locating member 40 is removed.

Internal combustion engine 10, as shown in FIG. 1, is provided with hydraulic lash adjuster 32 located within cylinder head 16. Ball plunger 52 of hydraulic lash adjuster 32 slideably carried in chamber 54 of cylinder 56. Ball plunger 52 is urged upwardly by lubricating fluid under pressure in chamber 54. Pressurized lubricating fluid is supplied to chamber 54 via oil galley 58. As is well known, lash adjuster 32 regulates lubricating fluid flow through port 60 within ball plunger 52. In addition, because it is desirable to provide lubricating fluid to all bearing surfaces in the valve train and in particular to the interface between cam 36 and cam responsive surface 38, rocker arm assembly 28 has channel 62 extending through pivot end 30 along axis 63 substantially perpendicular to longitudinal axis 65 of rocker arm body 29 (see FIG. 3) so as to receive lubricating fluid from port 60 and to provide the source of lubricating fluid to the valve train.

Referring to FIG. 2, lubricating fluid is directed toward the interface between cam 36 and cam responsive surface 38 by lubricating fluid directional control member 64. Lubricating fluid directional control member 64 is generally an inverted U-shaped member formed of an elastically tensioned material such as spring steel having portion 66 of top member 68 outwardly inclined relative to rocker arm assembly 28 thereby forming an opening 70 facing cam responsive surface 38 so as to direct lubricating fluid originating from oil galley 58 toward cam responsive surface 38. That is, once the fluid emerging from channel 62 contacts portion 66 of lubricating fluid directional control member 64, the fluid changes direction toward cam responsive surface 38 thereby providing lubricating fluid to the interface as previously stated.

Figure 6:
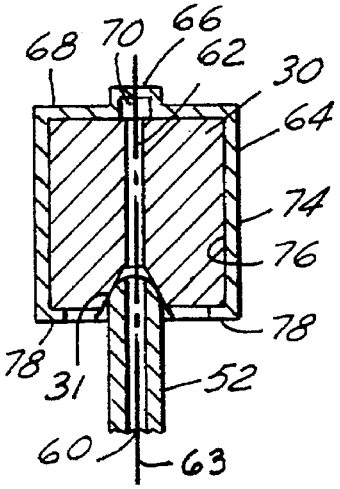

Lubricating fluid directional control member 64 has elongate sides 74 (one of which is shown in FIG. 2) for holding lubricating fluid directional control member 64 in place relative to rocker arm assembly 28. To further enhance the holding ability, rocker arm assembly 28 is formed with recess 76 located around the perimeter of pivot end 30 (see FIG. 3). Thus, top portion 68 and sides 74 of lubricating fluid directional control member 64 engage recess 76. As best shown in FIG. 6, lubricating fluid directional control member 64 may further have inwardly bent locking tab 78 at the bottom of side 74 so as to allow assembly of lubricating fluid directional control member 64 to rocker arm assembly 28.

Rocker arm body 29 may be manufactured by any manufacturing method known to those skilled in the art and suggested by this disclosure, including, without limitation, sand casting, investment casting, machining, powder metal pressing, forging, stamping, etc. The result is a low cost rocker arm body 29 which can be fitted with valve stem locating member 40 and lubricating fluid directional control member 64 so that the overall rocker arm assembly 28 has a reduced manufacturing cost. In particular, referring to FIG. 3, valve stem actuating end 34 has valve stem actuating surface 35 which is typically ground smooth so as to create a smooth sliding interface between surface 35 and valve stem 22. If valve stem locating member 40 had been formed into rocker arm body 29, then grinding of that surface 35 would be more difficult, requiring special fixtures and tooling. In addition, fluid channel 62 can either be drilled straight through rocker arm pivot end 30 or cast therein during manufacturing. It is to be appreciated that, according to the present invention, channel 62 need can be formed substantially perpendicular to the surface of rocker arm body 29 while rocker arm assembly 28 provides lubricating fluid toward cam responsive surface 38 because it is the function of lubricating directional control member 64 to guide fluid toward cam responsive surface 38. Thus according to the present invention, a rocker arm assembly having reduced manufacturing cost may be achieved with the added benefits of using a removably fixed valve stem locating member at one end thereof and a removably fixed lubricating fluid directional control member at another end thereof.

While the best mode in carrying out the invention has been described in detail, those having ordinary skill in art in which this invention relates will recognize various alternative designs and embodiments, including those mentioned above, in practicing the invention that have been defined by the following claims.

I claim:

1. A rocker arm assembly for an overhead cam internal combustion engine having at least one valve comprising:

a rocker arm body having a pivot end for engaging a pivot member of said engine, a valve actuating end opposite said pivot end for actuating said valve, and a cam responsive surface intermediate said pivot end and said valve actuating end for engaging said overhead cam, said rocker arm being responsive to the rotation of said cam such that, as said cam rotates, said rocker arm pivotally oscillates about said pivot member; and, an elastically tensioned valve stem locating member resiliently biased and removably attached to said valve actuating end to retain a valve stem of said valve relative to said valve actuating end.

2. A rocker arm assembly according to claim 1 wherein said pivot end has a lubricating fluid channel extending therethrough along an axis substantially perpendicular to a longitudinal axis of said rocker arm, said rocker arm assembly further comprising an elastically tensioned lubricating fluid directional control member removably fixed to said pivot end for directing lubricating fluid emerging from said channel toward said cam responsive surface.

3. An internal combustion engine comprising:

a cylinder head mounted to a cylinder block of said engine, said cylinder block having at least one cylinder;

a valve train comprising a valve having a valve stem extending through said cylinder head; a biasing means for biasing said valve relative to said cylinder head; a rocker arm for actuating said valve, said rocker arm having a pivot end, a valve actuating end engaging said valve stem of said valve, and a cam responsive surface intermediate said pivot end and said valve actuating end; a hydraulic lash adjuster mounted to said cylinder head and being in fluid communication with lubricating fluid of said engine, said hydraulic lash adjuster engaging said rocker arm at said pivot end and having a lubricating fluid channel therethrough for providing lubricating fluid from said hydraulic lash adjuster to said rocker arm, said pivot end of said rocker arm having a lubricating fluid channel extending therethrough along an axis substantially perpendicular to a longitudinal axis of said rocker arm for receiving lubricating fluid from said hydraulic lash adjuster; an overhead cam rotatably mounted to said cylinder head and being in contact with said cam responsive surface of said rocker arm for pivotally oscillating said rocker arm about said hydraulic lash adjuster; and, said rocker arm further comprising:

a valve stem locating member removably fixed to said valve actuating end for locating said valve actuating end relative to said valve stem of said valve; and, a lubricating fluid directional control member removably fixed to said pivot end for directing lubricating fluid emerging from said channel in said pivot end toward said cam responsive surface.

4. An internal combustion engine according to claim 3 wherein said valve stem locating member comprises a generally inverted U-shaped elastically tensioned clip having elongate sides extending beyond said valve actuating end so as to retain said valve stem, each said side having an inwardly bent locking tab along the length thereof for engaging said valve actuating end of said rocker arm.

5. An internal combustion engine according to claim 4 wherein said valve stem locating member is formed of spring steel.

6. An internal combustion engine according to claim 4 wherein said valve actuating end has a recessed area on a top surface thereof for receiving the top portion of said inverted U-shaped valve stem locating member.

7. An internal combustion engine according to claim 4 wherein said valve actuating end has a recessed area on a bottom surface thereof for receiving said inwardly bent locking tabs of said valve stem locating member.

8. An internal combustion engine according to claim 3 wherein said lubricating fluid directional control member comprises a generally inverted U-shaped elastically tensioned clip having a portion of a top member thereof outwardly inclined relative to a top surface of said rocker arm forming an opening facing said cam responsive surface thereby directing lubricating fluid emerging from said channel in said pivot end toward said cam responsive surface.

9. An internal combustion engine according to claim 8 wherein said lubricating fluid directional control member has elongate sides connected to said top member so as to engage said rocker arm, each said side having an inwardly bent locking tab at an end opposite said top member for engaging a bottom surface of said rocker arm at said pivot end.

10. An internal combustion engine according to claim 9 wherein said lubricating fluid directional control member is formed of spring steel.

11. An internal combustion engine according to claim 9 wherein said pivot end has a recessed area around the perimeter thereof for receiving said lubricating fluid directional control member.

12. A rocker arm comprising:

a rocker arm body comprising:

a pivot end having a lubricating fluid channel extending therethrough along an axis substantially perpendicular to a longitudinal axis of said rocker arm for engaging a pivot member of an internal combustion engine and having a recessed area around the perimeter thereof, a valve actuating end opposite said pivot end for actuating a valve of said engine, said valve actuating end having a recessed area on a top and a bottom surface thereof, and a cam responsive surface intermediate said pivot end and said valve actuating end for engaging an overhead cam of said engine, said rocker arm being responsive to the rotation of said cam such that, as said cam rotates, said rocker arm pivotally oscillates about said pivot member;

a generally inverted U-shaped elastically tensioned valve stem locating clip removably fixed within said top recessed area of said valve actuating end for locating said valve actuating end relative to said valve stem of said valve, said clip having elongate sides extending beyond said valve actuating end so as to retain said valve stem, each said side having an inwardly bent locking tab along the length thereof for engaging said bottom recessed area of said valve actuating end of said rocker arm; and, a generally inverted U-shaped elastically tensioned lubricating fluid directional control clip removably fixed within said recessed area of said pivot end having a portion of a top member thereof outwardly inclined relative to a top surface of said rocker arm forming an opening facing said cam responsive surface and having elongate sides connected to said top member so as to engage said rocker arm within said recessed area of said pivot end, each said side having an inwardly bent locking tab at an end opposite said top member for engaging said recessed area of said pivot end.

* * * * *